US005199557A

United States Patent [19]

Brandt et al.

[11] Patent Number: 5,199,557

[45] Date of Patent: Apr. 6, 1993

[54] METHOD OF PRODUCING AN ELECTRIC OR ELECTRONIC COMPONENT, A METHOD OF PRODUCING A KEY AND A KEY

[75] Inventors: Gert Brandt, Rødovre; Søren R. Hansen, Ballerup, both of Denmark

[73] Assignee: MEC A/S, Ballerup, Denmark

[21] Appl. No.: 615,306

[22] Filed: Nov. 19, 1990

Related U.S. Application Data

[63] Continuation of Ser. No. 457,178, Dec. 26, 1989, abandoned, which is a continuation of Ser. No. 156,827, Feb. 17, 1988, abandoned.

[30] Foreign Application Priority Data

Jan. 28, 1988 [DK] Denmark ..... 430/88

[51] Int. Cl.[5] ..... H01H 5/18; H01H 13/14

[52] U.S. Cl. ..... 200/406; 200/517; 200/288; 200/302.2; 200/345; 200/520; 200/521

[58] Field of Search ..... 200/406, 506, 513, 515, 200/516, 517, 267, 288, 302.2, 341, 344, 345, 520, 521; 181/207, 208

[56] References Cited

U.S. PATENT DOCUMENTS

| | | | |
|---|---|---|---|
| 2,948,461 | 8/1960 | Frank | 181/207 X |
| 3,617,660 | 11/1971 | Krakinowski | 200/512 X |
| 3,967,085 | 6/1976 | Lockard et al. | 200/302.2 |
| 4,102,039 | 7/1978 | Henrickson et al. | 29/593 |
| 4,125,934 | 11/1978 | Keough et al. | 29/622 |
| 4,146,767 | 3/1979 | Murata | 200/406 |
| 4,170,104 | 10/1979 | Yamagata | 200/302.2 X |
| 4,207,448 | 6/1980 | Furusawa et al. | 200/516 |
| 4,255,638 | 3/1981 | Contarino | 200/302.1 |
| 4,284,866 | 8/1981 | Bryce et al. | 200/517 |
| 4,331,851 | 5/1982 | Johnson | 200/517 |
| 4,342,893 | 8/1982 | Wolf | 200/268 |
| 4,352,964 | 10/1982 | English | 200/5 A |
| 4,412,113 | 10/1983 | Mitsugi et al. | 200/406 |
| 4,420,531 | 2/1984 | Wright | 428/329 |
| 4,659,881 | 4/1987 | Dowe | 200/5 R |
| 4,690,484 | 9/1987 | Oba et al. | 439/736 |
| 4,803,321 | 2/1989 | Lefebvre | 200/406 X |

FOREIGN PATENT DOCUMENTS

| | | |
|---|---|---|
| 30473 | 6/1981 | European Pat. Off. . |
| 146207 | 6/1985 | European Pat. Off. . |
| 164799 | 12/1985 | European Pat. Off. . |
| 2740746 | 3/1978 | Fed. Rep. of Germany . |
| 3542953 | 4/1986 | Fed. Rep. of Germany . |
| 3545798 | 7/1986 | Fed. Rep. of Germany . |
| 440836 | 8/1985 | Sweden . |
| 616731 | 1/1949 | United Kingdom . |

*Primary Examiner*—Henry J. Recla
*Assistant Examiner*—Glenn T. Barrett
*Attorney, Agent, or Firm*—Merchant, Gould, Smith, Edell, Welter & Schmidt

[57] ABSTRACT

In a process of producing an electric or electronic component, particularly a key, a continuous track of a metal foil is machined into two metallic terminal components constituting links between two carrier strips. A base housing component is cast from a high temperature resistant material around the terminals and is connected to the carrier strips through two tags protruding outwards from opposite, outer side surfaces of the base housing component. In an inner recess of the base housing component a domed metal disc having an acoustically damping coating on the convex side surface thereof, an elastically compressible rubber component and a push button are arranged. On top of the base housing component, a top housing component preferably made from the same high temperature resistant plastics material is arranged. Within the recess of the base housing component, the terminals define electric contacts with which the domed metal disc cooperates. The terminals are separated from the carrier strips and bent into the configuration of pins of an electronic key, and the key is still connected through the tags to the carrier strips transferred to a test stand, in which the key is tested. Provided the key is identified as a properly functioning key, the tags are separated from the base housing component.

12 Claims, 2 Drawing Sheets

Figure 1:
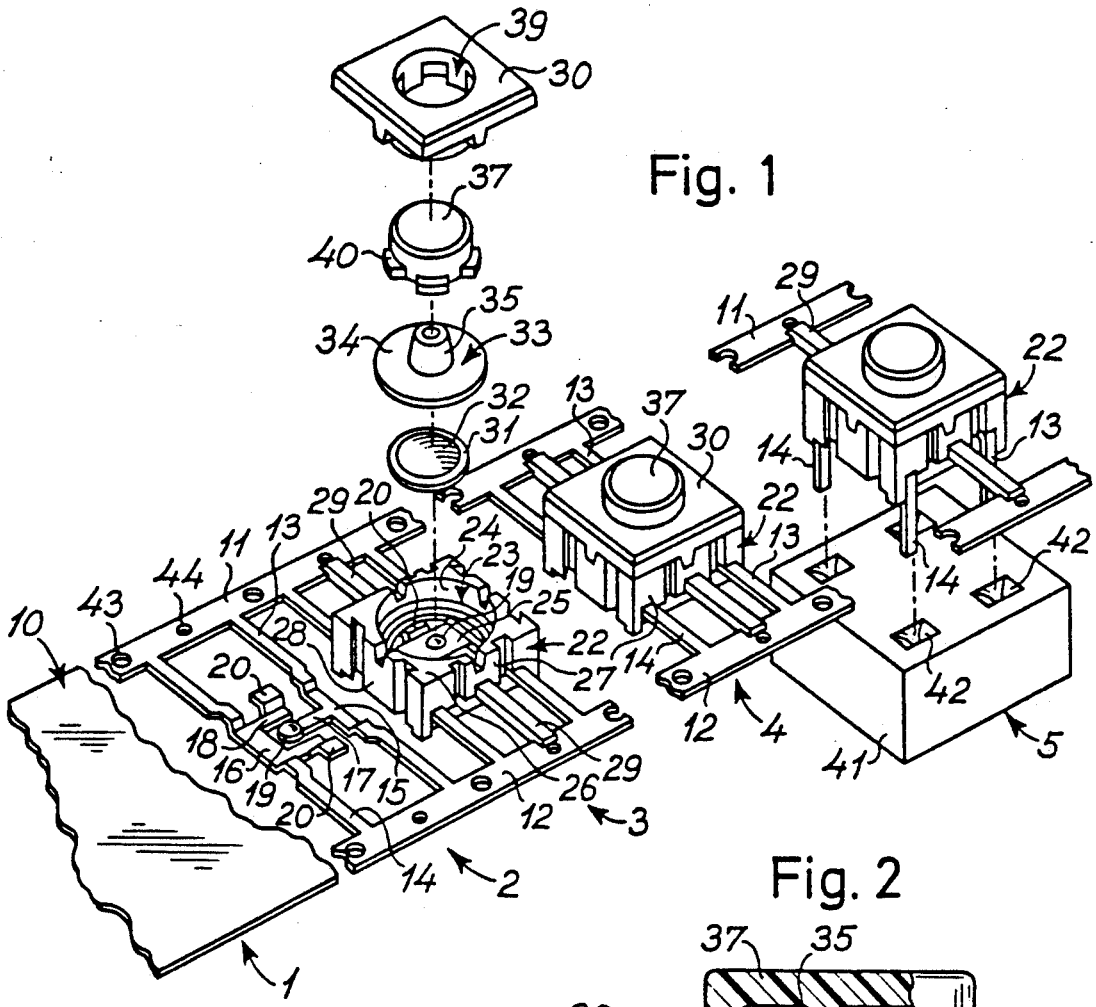

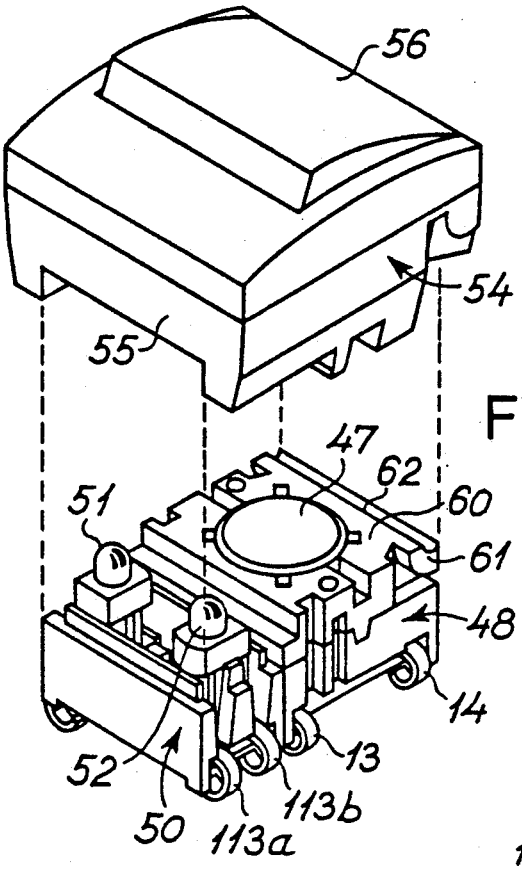
Fig. 4
Fig. 6
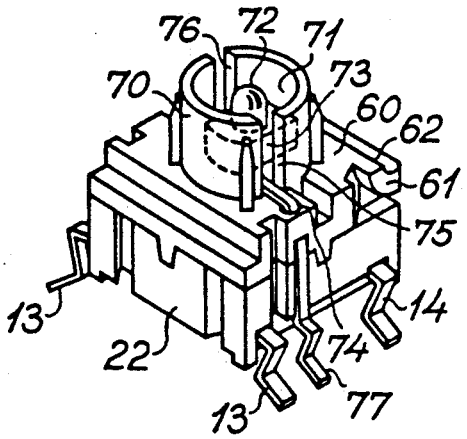
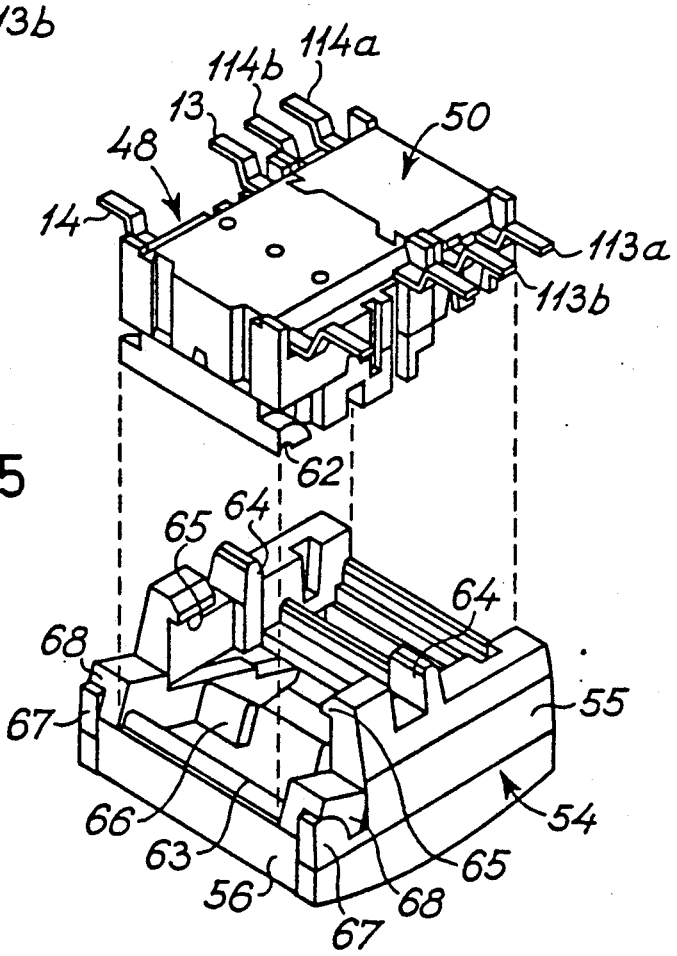
Fig. 5

METHOD OF PRODUCING AN ELECTRIC OR ELECTRONIC COMPONENT, A METHOD OF PRODUCING A KEY AND A KEY

This is a continuation of application Ser. No. 07/457,178, filed Dec. 26, 1989 which in turn is a continuation of 07/156,827 filed Feb. 17, 1988, both abandoned.

The present invention relates to the technical field of production of electric or electronic components, particularly the production of keys or switches and such keys or switches.

Within the above technical field, numerous methods of producing electric or eletronic components, in particular keys and switches, are known as well as numerous keys and switches.

An object of the present invention is to provide a method rendering it possible to produce an electric or electronic component, in particular a key or a switch, comprising few components.

A further object of the present invention is to provide a novel technique of producing an electric or electronic component. in particular a key or a switch, which may be used in accordance with so-called SMT-technique (SMT: Surface Mounting Technique), i.e. which may stand exposure to solder metal material, such as tin heated to a temperature of e.g. 240° C., for approx. 60 sec.

A still further object of the present invention is to provide a novel technique of producing an electric or electronic component, in particular a key or a switch, produced in a sequential process and tested prior to its delivery from the production line.

A still further object of the present invention is to provide a key and to provide a method for the production of such key, which key is of a compact, modular structure which allows the key to be used in connection with accessory components, such as modular display units, keyboard pads, etc.

The above and other objects and advantages obtained in accordance with the teachings of the present invention will be evident from the description below.

Thus, in accordance with a first aspect of the present invention, a method of producing an electric or electronic component is provided, said component comprising:

a housing of an insulating material having outer side walls, an active component part enclosed in said housing, and at least two metallic terminal components, each including:

an outer terminal extending outwards from an outer side wall of said housing and defining an outer terminal end, and an electric contact means electrically interacting with said active component part, said electric contact means being enclosed in said housing and integrally connected to said outer terminal at an end thereof opposite to said outer terminal end;

the method comprising the following sequence of steps:

(a) providing a continuous track of the metal of said metallic terminal components, (b) processing said continuous track so as to form said metallic terminal components and a carrier strip, said metallic terminal components being integrally connected to said carrier strip through said outer terminal ends, (c) casting a base housing component of said insulating material around said metallic terminal components, said base housing component defining outer side walls constituting at least part of said outer side walls of said housing through which outer side walls of said base housing component said outer terminals extend, said base housing component comprising at least one tag protruding outwards from an outer side wall of said base housing component and being cast to said carrier strip for establishing mechanical connection between said base housing component and said carrier strip, said base housing component further having a recess in which said electric contact means are exposed, (d) arranging said active component part in said recess of said base housing component so as to provide said electric interaction between said electric contact means and said active component part, (e) providing a top housing component, (f) arranging said top housing component relative to said base housing component together constituting said housing (g) separating said metallic terminal components from said carrier strip by separating said outer terminals from said carrier strip at said outer terminal ends, (h) testing said electric or electronic component produced in steps (a)–(g) in an electric test stand while said base housing component is mechanically connected to said carrier strip through said tag, and, (i) provided said electric or electronic component is identified as a properly working component, separating said tags from said base housing component.

In accordance with the method of the first aspect of the present invention, the electric or electronic component is manufactured from only four components, viz. the continuous track, the base housing component, the active component part and the top housing component. Since the base housing component is mechanically connected to the carrier strip through the tag. the electric or electronic component is, during its manufacturing process, advanced through a number of production stations corresponding to the above steps by moving the carrier strip. In accordance with a particular feature of the above method according to the first aspect of the present invention, the electric or electronic component is very easily tested in the above step (h) as the electric or electronic component produced in the above steps (a)–(g), which component is integrally connected to the carrier strip through the tag, is simply presented to the test stand.

In accordance with a preferred embodiment of the method according to the first aspect of the present invention, two carrier strips are processed in the above step (b) from said continuous track, between which carrier strips said metallic components are arranged having their outer terminal ends integrally connected to said carrier strips through said outer terminal ends, and two tags are further cast in above step (c) to a respective carrier strip. By the provision of two carrier strips and two tags cast to a respective carrier strip, the electric or electronic component is to a high degree mechanically supported in its fixation to the two carrier strips when the electric or electronic component is advanced through the above steps.

A further increase in the mechanical fixation and support of the electric or electronic component, when advanced through the above steps, is obtained in accordance with an alternative of the above preferred embodiment of the method according to the first aspect of the present invention in that each metallic terminal component constitutes a link between said two carrier strips, and each of said metallic components has two outer terminals defining outer terminal ends integrally connected to a respective carrier strip.

In the method according to the first aspect of the present invention, the active component part may constitute any electric or electronic component part known per se, such as a passive component part, e.g. a resistor, a potentiometer, a capacitor, a variable capacitor, an inductor, an active electronic component, such as an IC chip. e.g. a CMOS—(complementary metal oxide semiconductor) chip, a semiconductor component provided in accordance with silicon planar technique, a hybrid component, a thick- or thin-film electronic component, or combinations of the above alternatives.

However, a particularly important application of the above method according to the first aspect of the present invention is the production of keys. Thus, in accordance with the preferred embodiment of the method according to the above first aspect of the present invention, the electric or electronic component is a key, and the active component part is a domed metal disc. In accordance with this embodiment of the method according to the first aspect of the present invention, the disc is in step (d) arranged with its dome protruding outwards from said recess, which disc in its normally domed shape is out of electrically conductive contact with at least one of said electric contact means of said at least two metallic terminal components and may be deformed from said domed shape to a deflected shape, thereby establishing electrically conductive contact between said electric contact means of said at least two metallic terminal components, in accordance with which preferred embodiment said top housing component is in the above step (e) provided with an aperture, a stem means is further provided prior to step (f), and said stem means is in step (f) arranged in said aperture of said top housing component, which stem means is actuatable acting on said metal disc for deforming it from said domed shape to said deflected shape by actuation.

An elastically compressible body means is preferably arranged between said stem means and said metal disc in step (f), and, as will be explained below, the elastically compressible body means serves more purposes, viz. to increase the travel or stroke of the metal disc when deformed and optionally to protect the metal disc by sealing along the circumferential edge of the disc and consequently protecting the metal disc and the electric contact means from corrosive gases and exposure to high temperatures in a surface mounting process, as the key is soldered to a supporting circuit board, e.g. in a wave soldering machine.

A domed metal disc produces an unpleasent and harsh click, when it is deformed. In accordance with a particular aspect of the present invention, it has been realised that the click may be damped resulting in a more pleasent sound by providing an acoustically damping material coating or layer on the one side surface of the domed metal disc, which side surface constitutes the outer or convex side surface of the domed metal disc.

In accordance with a second aspect of the present invention, a method of producing a key is provided, which key comprises:

a housing of an insulating material having outer side walls, a switching element enclosed in said housing, and at least two metallic terminal components, each including:

an outer terminal extending outwards from an outer side wall of said housing and defining an outer terminal end, and an electric contact means electrically interacting with said switching element, said electric contact means being enclosed in said housing and integrally connected to said outer terminal at an end thereof opposite to said outer terminal end;

said switching element being switchable between a first state in which said switching element is out of electrically conductive contact with at least one of said electric contact means of said at least two metallic terminal components, and a second state in which said switching element is establishing electrically conductive contact between said electric contact means of said at least two metallic components;

the method comprising the following sequence of steps:

(a) providing a continuous track of the metal of said metallic terminal components, (b) processing said continuous track so as to form said metallic terminal components and a carrier strip, said metallic terminal components being integrally connected to said carrier strip through said outer terminal ends, (c) casting a base housing component of said insulating material around said metallic terminal components, said base housing component defining outer side walls constituting at least part of said outer side walls of said housing through which outer side walls of said base housing component said outer terminals extend, said base housing component further having a recess in which said electric contact means are exposed, (d) arranging said switching element in said recess of said base housing component so as to be switchable between said first and second states, (e) providing a top housing component having an aperture and providing a stem means, (f) arranging said stem means in said aperture of said top housing component and arranging said top housing component relative to said base housing component together constituting said housing, said stem means being arranged relative to said switching element so as to switch said switching element between said first and said second states by actuation, (g) separating said metallic terminal components from said carrier strip by separating said outer terminals from said carrier strip at said outer terminal ends, and (h) testing said key in a test stand and actuating said stem means in order to test, if said switching element is switchable between said first and second states.

in said first state is out of electrically conductive contact with at least one of said electric contact means of said at least two metallic terminal components and if said switching element in said second state is establishing electrically conductive contact between said electric contact means of said at least two metallic terminal components.

In accordance with the second aspect of the present invention, the key is produced from a metal track, a base housing component, a switching element, a top housing component and a stem means in a production process, where the key is advanced from one step to a subsequent step by means of the carrier strip, and tested in a test stand.

The above method according to the second aspect of the present invention may advantageously further comprise any of the aspects of the above described embodiments of the method according to the first aspect of the present invention.

Furthermore, the key produced in accordance with the method according to the second aspect of the present invention, is preferably a key which may stand exposure to elevated temperatures, such as 240° C., during e.g. 60 sec, e.g. in a surface mounting process, e.g. in a wave soldering machine, as the base and top housing components of the key are preferably cast from a high-temperature resistant plastics material.

In accordance with a third aspect of the present invention, a key is provided, which key comprises:

a housing of an insulating material having outer side walls, a switching element enclosed in said housing, and at least two metallic terminal components, each including:

an outer terminal extending outwards from an outer side wall of said housing and defining an outer terminal end, and an electric contact means electrically interacting with said switching element, said electric contact means being enclosed in said housing and integrally connected to said outer terminal at an end thereof opposite to said outer terminal end;

said switching element being switchable between a first state in which said switching element is out of electrically conductive contact with at least one of said electric contact means of said at least two metallic terminal components, and a second state in which said switching element is establishing electrically conductive contact between said electric contact means of said at least two metallic components;

said housing comprising:

a base housing component of said insulating material cast around said metallic terminal components, a top housing component having an aperture and a stem means, said base housing component defining outer side walls constituting at least part of said outer side walls of said housing through which outer side walls of said base housing component said outer terminals extend, said base housing component further having a recess in which said electric contact means are exposed, said switching element being arranged in said recess of said base housing component so as to be switchable between said first and second states, said stem means being arranged in said aperture of said top housing component, said top housing component being arranged relative to said base housing component together defining said housing, and said stem means being arranged relative to said switching element so as to switch said switching element between said first and said second states by actuation.

The key according to the above third aspect of the present invention is preferably of the type in which the switching element is a domed metal disc, which disc is arranged in said recess of said base housing component with its dome protruding outwards from said recess, and which disc in its normally domed shape is in said first state and is deformable from said domed shape into a deflected shape constituting said second state.

As explained above, the key according to the present invention preferably further comprises an elastically compressible body means arranged between the stem means and the metal disc, which body means constitutes a means for increasing the stroke of the metal disc to a larger stroke of the stem means.

Furthermore, in the above preferred embodiment of the key according to the present invention, the metal disc is preferably made from a metal foil with a coating of an acoustically damping material on one side surface, which side surface constitutes the outer or convex side surface of said domed metal disc, in order to eliminate the unpleasent and harsh click generated by an undamped, domed metal disc. In the preferred embodiment of the key according to the third aspect of the present invention, the key is a key which may stand exposure to high temperatures, such as 240° C., for e.g. 60 sec, as the key is exposed to e.g. solder in a surface mounting process. The base and top housing components are made from a high temperature resistant plastics material, such as high-crystalline copolymers, epoxy resins, olephine-carbon-monoxide copolymers, polycarbonates, polyolephine sulphonates, e.g. polyethylene sulphonate, PES, or polyethylene-terephthalates, e.g. PETP or PET.

In order to seal the domed metal disc and consequently protect the domed metal disc against exposure to gases, such as corrosive gases, and to elevated temperatures, e.g. in the above mentioned surface mounting process, the key according to the present invention may further have its stem means, body means and domed metal disc arranged coaxially relative to each other, and the elastically compressible body means may preferably comprise a circular membrane part having a circumferential bead and a central stem part, said stem part of said body means constituting an elastically compressible part for the transmission of the actuation of said stem means to said domed metal disc, which domed metal disc is preferably arranged within the circumferential bead of the membrane part so as to have said bead seal along the circumferential edge of the domed metal disc and consequently seal the domed metal disc relative to the environment.

In the above described preferred embodiment of the key according to the invention, the elastically compressible body means is advantageously made from silicon rubber and the domed metal disc is advantageously made from a CuBe foil of a thickness of e.g. 0.075 mm.

Figure 2:
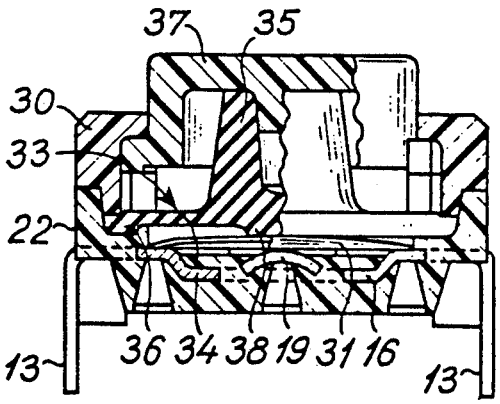
Figure 3:
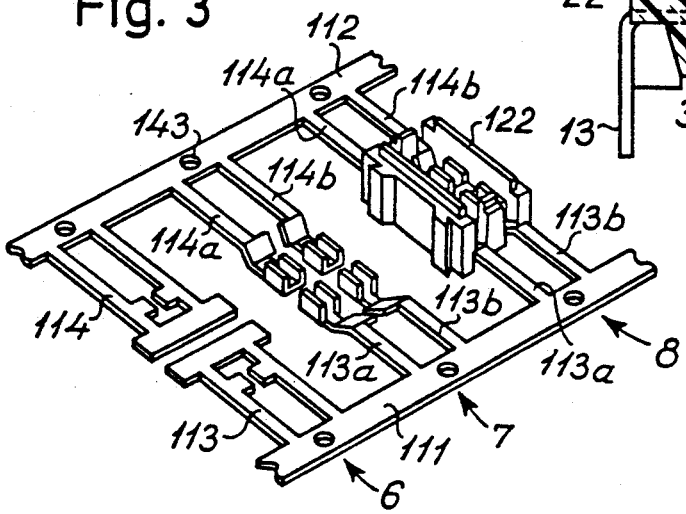

The invention will now be further described with reference to the drawings, in which FIG. 1 is a schematical and perspective view of a production line in which a key is produced in accordance with the methods according to the present invention, FIG. 2 is a partly vertical sectional view of the key shown in FIG. 1, FIG. 3 is a schematical and perspective view illustrating the production of an accessory component of the key shown in FIGS. 1 and 2 in accordance with the method of the present invention, FIG. 4 is a schematical, perspective and partly exploded view of a combination of a key according to the present invention, and an accessory component including two light emitting diodes and produced in accordance with the method according to the present invention, and a manually operable key housing component, FIG. 5 is a schematical, perspective and partly exploded view of the combination shown in FIG. 4, turned upside down, and FIG. 6 is a schematical and perspective view of a combination of a key according to the present invention and a light emitting diode support constituting an accessory top housing component of the key.

In FIG. 1, a method according to the present invention of producing a key according to the present invention is illustrated comprising five individual production steps schematically illustrated by posititions designated the reference numerals 1–5. In position 1, a metal plate is provided constituting a continuous track of a metal foil 10. In position 2, the metal foil track 10 is machined in a punching tool, not shown in FIG. 1, and processed into two carrier strips 11 and 12 between which two terminal assemblies 13 and 14 extend. As will be evident from the description below, each of the terminal assemblies 13 and 14 is in a subsequent production step machined into two terminals. Thus, the terminal assemblies 13 and 14 are integrally connected to the carrier strips 11 and 12 through ends of the terminal assemblies, which ends are intended to constitute the outer terminal ends of the above mentioned terminals. As is evident from FIG. 1, the terminal assembly 13 is machined into a shape defining a centrally indented bar 15, from which a contact bar 17 extends towards the adjacent terminal assembly 14. The outer end of the contact bar 17 remote from the indented bar 15 is further machined into a domed contact pad 19. As is also evident from FIG. 1, the terminal assembly 14 is also machined into a shape defining a centrally indented part 16, from which two connector bars 18 extend towards the adjacent terminal assembly 13. The contact bars 18 are further provided with raised, outer contact parts 20.

In position 3, a base housing component 22 is cast around the above described components 15–20 of the terminal assemblies 13 and 14. The base housing component 22 is cast with a central recess 23 defining a circumferential inner surface 24 and a bottom surface 25, from which the contact pad 19 and the raised, outer contact parts 20 protrude upwards. The base housing component 22 further defines a top surface 26, a bottom surface, not shown in FIG. 1, a first outer side surface 27, which faces the carrier strip 12, and a second outer side surface 28. The surfaces 26, 27 and 28 are perpendicular to each other. The base housing component 22 further has a bottom surface, not shown in FIG. 1, parallel with the top surface 26, and two outer side surfaces, not shown in FIG. 1, parallel with the first and a second outer side surfaces 27 and 28, respectively. From the first outer side surface 27 and further from the outer side surface not shown in FIG. 1 parallel therewith carrier tags 29 protrude. The carrier tags 29 are cast integrally to the base housing component 22 and to the respective carrier strips 11 and 12.

As is evident from FIG. 1, the base housing component 22 is further at its top surface 26 and its outer side surfaces 27 and 28 provided with indents mating with a top housing component 30 and accessory components to be described below, respectively.

In the above described, cast base housing component 22, a domed metal disc 31 is arranged, which metal disc has its dome facing upwards, i.e. outwards from the recess 23 of the base housing component 22. The domed metal disc 31 is in its normally domed shape in contact with the contact parts 20, however, out of contact with the central contact pad 19, and does consequently not in its normally domed shape establish electrically conductive connection between the contact pad 19 and the outer contact parts 20 and further between the terminal assemblies 14 and 13. The domed metal disc 31 is at its upper or convex side surface provided with a central coating 32 of an acoustically damping material, e.g. of silicone, serving the purpose of altering the unpleasent and harsh noise generated by an undamped domed metal disc, when the metal disc is deformed from its domed shape to a deformed shape and vice versa into a more pleasent, damped noise. On top of the domed metal disc 31, a rubber component 33 is arranged, which comprises two integrally connected parts, a membrane part 34 and a stem part 35. The membrane part 34 has, as is evident from FIG. 1, a larger outer diametre than the domed metal disc 31 and circumferential bead 36. The bead 36 serves the purpose of sealing along the outer circumferential edge of the domed metal disc 31.

The stem part 35 is a hollow part, which is elastically deformable and serves the purpose of transmitting a mechanical force from a button 37 to which said mechanical force is applied to the domed metal disc and further the purpose of increasing the stroke of travel of the button 37 relative to the stroke of travel of the domed metal disc, as the metal disc is deformed or allowed to revert to its normally domed shape from its deformed shape, by the elastic deformation of the stem part 35.

As is evident from FIG. 2, the membrane part 34 is at its lower side surface provided with a protruding part 38 serving the purpose of contacting the central part of the domed metal disc 31, when the stem part 35 is actuated and forced downwards by the button 37. As the domed metal disc 31 and the rubber component 33 are arranged in the recess 23 of the base housing component 22 the top housing component 30 is, with the button 37 arranged in a central aperture of the top housing component 30, arranged on top of the base housing component 22 and fixed thereto. The top housing component 30 is, as is evident from FIG. 1, provided with a central cylindrical bottom part fitting into the recess 23 in a snap fitting as is evident from FIG. 2, and further provided with downwards protruding fins for cooperating with the above mentioned indents of the top surface 26 of the base housing component 22. The travel of the button 37 within the aperture 39 of the top housing component 30 is controlled by fins 40 protruding outwards from the circumferential outer side surface of the button 37 at the lower edge thereof, as is evident from FIG. 1, which fins 40 are adapted to cooperate with indents of the inner wall of the aperture 39 of the top housing component 30.

In position 4, the above described key assembly is assembled from the base housing component 22, the top housing component 30 and the button 37. From the first outer side surface 27 and the opposite, parallel side surface, the terminal assemblies 13 and 14 protrude. In position 4, the terminal assemblies 13 and 14 are separated from the carrier strips 11 and 12 at the outer ends thereof. Consequently, the key assembly is connected to the carrier strips 11 and 12 through the tags 29, exclusively.

As the key assembly leaves position 4, the outer terminals defined by the parts of the terminal assemblies 13 and 14 extending outwards from the base housing component 22 are bent downwards, as is evident from the key assembly disclosed in position 5 of FIG. 1. By the separation of the terminal assemblies 13 and 14 from the carrier strips 11 and 12, the short circuiting connection between the terminal assemblies 13 and 14 through the carrier strips 11 and 12 is eliminated. When still mechanically supported by the carrier strips 11 and 12 through the tags 29 connecting the base housing component 22 to the carrier strips 11 and 12 the key assembly may in position 5 be tested in an automatic electric test stand. The test stand is illustrated schematically by a test block 41, which is moved from the position shown in FIG. 1 upwards so as to receive the outer ends of the terminals defined by the terminal assemblies 13 and 14 in apertures 42 of the block 41. In the apertures 42, metal contact means are provided so as to establish electrically conductive contact to the terminals 13 and 14 and are connected to a test circuit, not shown in FIG. 1, which is capable of determining the presence or absence of a short-circuiting condition. By further actuating the button 37 and consequently deforming the domed metal disc 31 from its normally domed shape into its deformed shape by the interaction of the rubber component 33, and still monitoring the presence or absence of a short-circuiting condition between the terminals 13 and 14, the key assembly is easily tested. The object is to determine if the key assembly is a properly functioning key, which in its inactuated state does not establish electrically conductive connection between the terminals 13 and the terminals 14, and which in its actuated state establishes electrically conductive connection between the terminals 13 and 14. Provided the key assembly has been identified as a properly working key assembly, it is separated from the carrier strips 11 and 12 by cutting or breaking the key assembly loose from the tags 29.

In FIG. 1, the carrier strips 11 and 12 are provided with through-going holes 43 and 44. The above described process of producing a key assembly according to the present invention is indicated above and carried out by moving the track 10 from position 1 to position 5 by well-known computer controlled mechanical advancing means. The holes 43 and 44 consequently serve the purpose of cooperating with gripping means for advancing the track 10 and further, or alternatively, with e.g. optica detector means to inform the process controlling computer about the position of the track or the carrier strips 11 and 12 relative to an intended position in one of the positions 1–5 shown in FIG. 1.

In FIG. 2 a vertical sectional view of the key assembly described above is shown disclosing the above described components and further in greater detail the sealing of the domed metal disc 31 relative to the environment by the bead 36 of the membrane part 34 of the rubber component 33.

In a production line for the production of the key described above with reference to FIGS. 1 and 2, the metal plate 10 from which the key is produced may be advanced through a number of processing stations. Alternatively, the metal plate 10 may be stationary and the production stations may be moved in relation to the metal plate. Furthermore, the production line may constitute any appropriate combination of the above possibilities, viz. the advancing of the metal plate 10 in relation to the stations and the movement of the stations in relation to the metal plate. However, a very important aspect of the present invention is the permanent fixation of the key in relation to the metal plate 10 or to the carrier strips 11 and 12 until the key has been tested and positively identified as a properly functioning key. Thus, the key is not to be transferred from its production line to a test stand as the key is permanently fixed to the carrier strips 11 and 12 and consequently in a fixed position in relation to the tools of the individual stations 2–5, particularly in a fixed position in relation to the block 41 constituting part of a test stand shown in position 5 of FIG. 1.

As mentioned above, the key assembly described with reference to FIGS. 1 and 2 is adapted to cooperate with accessory components, such as a display assembly 50 shown in FIG. 4. The display assembly 50 is in FIG. 4 mechanically connected to a key assembly according to the present invention, which key assembly is designated the reference numeral 48 in its entirety, through outwardly protruding dovetail shaped locking means cooperating with the above mentioned indents of the outer side surface 28 shown in FIG. 1. By these interlocking dovetail shaped male and female locking means, the display assembly 50 is connected and mechanically fixed to the key assembly 48. The key assembly 48 differs from the key assembly described with reference to FIGS. 1 and 2 in that the button 37 is substituted by a button 47 and in that the top housing component 30 is substituted by a top housing component 60, the top surface of which is at the same level as the button 47.

The display assembly 50 comprises two light emitting diodes 51 and 52, which are received in the housing of the display assembly 50 and connected to terminals thereof, which terminals are designated the reference numerals 113 and 114 and, like the terminals 13 and 14 of the key assembly 48, of a configuration allowing the mounting of the key assembly 48 and the display assembly 50 in a surface mounting process, which terminals are known in the art as terminal type "J" SMD. Obviously, the accessory assembly 50 may comprise alternative components. Thus, the two light emitting diodes 51 and 52 only constitute examples of components of the display assembly 50 and may in an alternative embodiment be replaced by e.g. a single light emitting diode, one or more incandescent lamps etc. Furthermore or alternatively, the accessory assembly 50 may comprise one or more active or passive components, such as an integrated circuit, a transistor, a resistor a capacitor, or a relay. Apart from the accessory component or display assembly 50, the key assembly 48 cooperates in FIG. 4 with a push button assembly 54, which comprises two parts, viz. a fixed housing part 55, which is mounted and fixed relative to the assemblies 48 and 50, and a movable or pivotable part 56. The top housing component 60 also differs from the above described top housing component 30 shown in FIGS. 1 and 2 in that the top housing component 60 is provided with a further component 61 defining an outer groove 62 for cooperating with an axial part of the pivotable part 56 of the push button assembly 54.

In FIG. 5, the above assemblies 48, 50 and 54 are shown turned upside down. Thus, in FIG. 5 the above mentioned axial part cooperating with the groove 62 is shown designated the reference numeral 63. In FIG. 5, two protruding parts 64 of the fixed housing part 55 of the push button assembly 54 is further shown serving the purpose of cooperating with the indents mentioned above with reference to FIG. 1 of the outer side surface 27 and further of the opposite outer side surface of the base housing component 22. The fixed housing part 55 is further provided with snap-locking means 65 serving the purpose of gripping around the key assembly 48 and fixing the housing part 55 thereto. As is evident from FIG. 5, the housing part 55 is further provided with two protruding journalling means 67 cooperating with mating journalling means 68 of the pivotable part 56 of the push button assembly 54, which is further provided with a protruding stem means 66 for transferring a mechanical pressure applied to the pivotable part 56 to the push button 47 and further to the internal contact element of the key constituted by the domed metal disc 31, shown in FIGS. 1 and 2.

The key assembly 48 and the display assembly 50 shown in FIG. 5, however, differ from the key assembly 48 and the display assembly 50 shown in FIG. 4 in that the terminals 13, 14 and 113, 114 are of a different configuration, viz. the SMD terminal configuration known in the art as "Gull Wing".

In FIG. 3, three positions 6, 7 and 8 of a sequential process according to the present invention of producing the component or display assembly 50 described above with reference to FIGS. 4 and 5 are shown. From a metal track similar to the above described metal track 10 shown in FIG. 1, two carrier strips 111 and 112 are punched and brought to the first position designated 6 in FIG. 3. As is evident from FIG. 3, two terminal assemblies 113 and 114 are further punched from the above mentioned metal track. The terminal assemblies 113 and 114, however, differ from the terminal assemblies 13 and 14 shown in FIG. 1 in that the terminal assemblies 113 and 114 do not constitute links between the carrier strips 111 and 112. Thus, the terminal assembly 113 is connected to the carrier strip 111, exclusively, whereas the terminal assembly 114 is connected to the carrier strip 112, exclusively. In position 7, the terminal assemblies 113 and 114 are further processed and each separated into two individual terminal assemblies. Thus, the terminal assembly 113 is divided into two terminal assemblies 113*a* and 113*b*, while the terminal assembly 114 is separated into two terminal assemblies 114*a* and 114*b*. The parts of the terminal assemblies 113*a,b* and 114*a,b* remote from the carrier strips 111 and 112, respectively, are further indented and bent into the shape shown in FIG. 3. In position 8, a housing part 122 is cast around the terminals 113*a,b* and 114*a,b*. After the casting step shown in position 8, the component constituting the housing of the display assembly 50 shown in FIGS. 4 and 5 is separated from the carrier strips 111 and 112. As is evident from FIG. 3, the carrier strips 111 and 112 are provided with through-going holes 143 corresponding to the holes 43 and 44 of the carrier strips 11 and 12 shown in FIG. 1.

It is to be realised that the above described key or key assembly according to the present invention is of a modular configuration, as the key assembly may cooperate with an accessory component such as the above described display assembly and the above described push button assembly, which as will be evident to the skilled art worker is translucent or is provided with a translucent part. Thus, the pivotable part 56 of the push button 54 may advantageously be made from a translucent material, which is illuminated by the light emitting diodes 51 and 52 of the display assembly 50. Furthermore, as will be evident from the description of FIG. 4 the push button or the top housing component of the key assembly 48 may be modified in order to meet special requirements.

In FIG. 6, a key assembly for the present invention is shown, which key assembly is modified relative to the above described key assembly 48 shown in FIGS. 4 and 5, in that a push button extender 70 is arranged on top of the push button 47 shown in FIG. 4, which push-botton extender 70 is of a cylindrical configuration. The push button extender 70 defines an inner space 71, in which a light emitting diode 72 is arranged, which diode is mounted in a socket 73 received in the inner space 71. The light emitting diode 72 has its pins extending through slits 75 and 76 of the push button extender 70 and further through apertures of the top housing component 60 of the key assembly. In FIG. 6, one of the apertures of the top housing component 60 of the key assembly is designated the reference numeral 74. One of the pins of the light emitting diode 72 is also shown in FIG. 6 and designated the reference numeral 77. In FIG. 6, the terminals 13 and 14 of the key assembly and further the pin 77 of the light emitting diode 72 are of a configuration different from the terminal configurations shown in FIGS. 4 and 5. Thus, it is to be realised that the terminals 13 and 14 and further any pins or terminals of accessory components such as the pin 77 or the terminals 13 and 114 may be of any appropriate configuration.

EXAMPLE 1

In a prototype implementation of the key assembly shown in FIGS. 1 and 2, the carrier strips 11 and 12 and the terminal assemblies 13 and 14 were machined from 0.3 mm silver-plated tin-bronze. The carrier strips 11 and 12 had a width of 3 mm, and the distance between the centre lines of the carrier strips 11 and 12 was 23.96 mm. The distance between the terminal assemblies 13 and 14 was 7.6 mm, the diameters of the holes 44 was 1.2 mm, which holes were arranged at the centre lines of the carrier strips 11 and 12 and further at intermediate positions relative to the terminal assemblies 13 and 14, the diametre of the holes 43 was 1.8 mm. The width of the indented part 16 was 4.4 mm, the raised contact parts 20 were raised 0.5 mm relative to the indented part 16. The raised contact parts 20 and the contact pad 19 were positioned centrally or at the intermediate line of the terminal assemblies 13 and 14. The contact pad 19 was raised 0.45 mm relative to the indented bar 15, and was constituted by a dome with a radius of 1.35 mm defining a circular contact pad of a diametre of 1.224 mm.

The base housing component 22, the top housing component 30 and the button 37 were cast from polycarbonate, or alternatively PES or PETP.

The shrinkage of the components was less than approx. 0.5 percent. The push button 37 was of a diametre of 6.5 mm and a height of 2.8 mm. The fins 40 had a height of 0.8 mm, and oppositely positioned fins defined a maximum outer diametre of 7.65 mm. The button 37 further had a central, inwardly protruding part shown in FIG. 2, which part defined a height of 0.95 mm from the lower side surface of the bottom.

The assembly comprising the base housing component 22 and the top housing component 30 defined a height of 5 mm, while the maximum height of the key assembly from the lower side surface of the base housing component 22 to the top surface of the key 37 was 6.4 mm. The outer dimensions of the bottom and top housing parts were 10 mm×10 mm.

The rubber component 33 was made from silicone rubber of a hardness of 38 Shore+−2. The outer diametre of the membrane part 34 was 8.83 mm, the inner diametre defined within the bead 36 was 6.8 mm, the thickness of the membrane 34 was 0.3 mm, and the overall thickness of the bead was 0.63 mm. The central protruding part 38 defined a circular surface of a diametre of 1.4 mm protruding 0.4 mm from the lower side surface of the membrane part 34. The stem part 35 was a hollow, cylindrical part of a height of 3.16 mm, which stem part defined an upper outer diametre of 2.8 mm, an angle of taper of the outer cylindrical side surface of the stem part 35 of 7°, an inner recess of a depth of 2.5 mm and of a inner diametre of 1 mm and defining by its inner cylindrical surface an angle of taper of 5°.

The domed metal disc 31 was made from 0.075 mm copper beryllium alloy. The outer diametre of the metal disc 31 was 6.4 mm and the maximum diametre of the acoustically damping coating 32 was 5 mm. The arch or dome radius of the disc was 39.1 mm, and the height of the dome was 0.25 mm. The domed metal disc was deformed from its normally do med shape by the application of a pressure of 155–165 g and reverted from its deformed shape to its normally domed shape when the pressure applied to the domed metal disc was less than 115–125 g.

Together the rubber component 33 and the domed metal disc 31 provided an increase of the stroke of the domed metal disc 31 of approximately 0.25 mm–0.3 mm to a total stroke or travel of the push button 37 of approximately 0.8 mm–1 mm.

EXAMPLE 2

The accessory component or display assembly 50 shown in FIG. 4 was in a prototype implementation made from a terminal plate constituted by a silver-plated tin-bronze plate and a housing cast from polycarbonate, PES or alternatively PETP, like the key described above in example 1.

Although the invention has been described above with reference to specific embodiments and implementations, it is to be understood that the present invention is not limited to the above embodiments and implementations, thus, numerous modifications and amendments are obvious to a person having ordinary skill in the art within the scope of the present invention as defined in the appending claims.

We claim:

1. A key comprising:

a housing of an electrically insulating material defining a recess therein, at least two mutually spaced metallic terminal components each including an outer terminal and extending out from the housing and an inner contact means exposed in said recess, a switching element arranged within the recess and being switchable between a first state, in which it is out of electrically conductive contact with at least one of the electric contact means, and a second state, in which the switching element is contacting both of said contact means so as to establish electrically conductive contact therebetween, a membrane of an elastic material extending transversely to the recess so as to define therein a sealed chamber containing the switching element and the contact means, a first side surface of the membrane being in abutting engagement with the switching element, a stem part made from an elastically compressible material extending from a second opposite side surface of the membrane, the stem part being formed integrally with the membrane, extending substantially at right angles to the membrane, from a central part thereof, and having an outer free end, the stem having a conical shape with a base of the conical shape in contact with the membrane, the stem further having an inner hollow portion, and an actuating member connected to the outer free end of said stem part and being movable in relation to the housing, whereby the switching element may be switched between its first and second states by depressing the actuating member, the movement of the actuating member being transmitted to the switching element through the elastically compressible stem part.

2. A key according to claim 1, wherein the first side surface of the membrane contains a radial protrusion for contacting a central part of the switching element.

3. The key according to claim 1 wherein the inner hollow portion of the stem has a conical shape.

4. A key according to claim 1, wherein the switching element comprises a domed disc having a concave side engaging with the membrane, the switching element being switchable between its first and second states by deflecting the domed disc to a flattened shape.

5. A key according to claim 1, wherein the elastically compressible stem part is made from silicone rubber.

6. A key according to claim 1, wherein the housing is made from a high temperature resistant plastics material.

7. A key according to claim 6, wherein the stem part is formed integrally with the membrane from silicone rubber.

8. A key comprising:

a housing of an insulating material and including a base housing component defining a recess therein and a top housing component, at least two metallic terminal components embedded in the insulating material of the base housing component, each including an outer terminal extending outward from an outer side wall of the housing and defining an outer terminal end, and an electric contact means exposed in said recess, a switching element arranged within the recess and being switchable between a first state, in which it is out of electrically conductive contact with at least one of the electric contact means, and a second state in which the switching element is establishing electrically conductive contact between the electric contact means, the switching element comprising a domed disc having a concave side engaging with the membrane, the switching element being switchable from its first to its second state by deflecting the domed disc to a flattened shape, the domed disc comprising an inner metal layer and an outer layer of an acoustically damping material, a circular membrane having a circumferential bead, which is sealed to an inner wall of the base housing component defining the recess, and a central stem part made from an elastically compressible material and formed integrally with the membrane, the central stem having an outer free end exposed in a aperture defined in the top housing component and having a stroke of movement along an axis of the stem, the membrane being arranged between the stem part and the switching element so that the key made by actuated by depressing the outer free end of the stem part, whereby the switching element may be switched between its first and second states, the stroke of movement of the outer free end of the stem part being partly absorbed by the elastically compressible stem part, so that the movement of the free end of the stem part substantially exceeds the movement of the switching element.

9. A key according to claim 8, wherein the inner metal layer is made from a CuBe alloy foil of a thickness of 0.075 mm.

10. A key according to claim 8, wherein the membrane comprises a peripheral bead sealingly received in an annular channel defined in an inner housing wall defining said recess.

11. A key comprising:

a housing of an electrically insulating material defining a recess therein, at least two mutually spaced metallic terminal components each including an outer terminal end extending out from the housing and an inner contact means exposed in said recess, a switching element arranged within the recess and being switchable between a first state, in which it is out of electrically conductive contact with at least one of the electric contact means, and a second state, in which the switching element is contacting both of said contact means so as to establish electrically conductive contact therebetween, the switching element comprising a domed disc having a concave side engaging with the membrane, the switching element being switchable between its first and second states by deflecting the domed disc to a flattened shape, the domed disc comprising an inner metal layer and an outer layer of a damping material, a membrane of an elastic material extending transversely to the recess so as to define therein a sealed chamber containing the switching element and the contact means, a first side surface of the membrane being in abutting engagement with the switching element, a stem part made from an elastically compressible material extending from a second opposite side surface of the membrane, the stem part being formed integrally with the membrane, extending substantially at right angles to the membrane from a central part thereof, and having an outer free end, and an actuating member connected to the outer free end of said stem part and being movable in relation to the housing, whereby the switching element may be switched between its first and second states by depressing the actuating member, the movement of the actuating member being transmitted to the switching part through the elastically compressible stem part.

12. A key comprising:

a housing of an electrically insulating material defining a recess therein, at least two mutually spaced metallic terminal components each including an outer terminal end extending out from the housing and an inner contact means exposed in said recess, a switching element arranged within the recess and being switchable between a first state, in which it is out of electrically conductive contact with at least one of the electric contact means, and a second state, in which the switching element is contacting both of said contact means so as to establish electrically conductive contact therebetween, a planar membrane of an elastic material extending transversely to the recess so as to define therein a sealed chamber containing the switching element and the contact means, a first side surface of the membrane being in abutting engagement with the switching element, a stem part made from an elastically compressible material extending from a second opposite side surface of the membrane, the stem part being formed integrally with the membrane, extending substantially at right angles to the membrane from a central part thereof, and having an outer free end, the stem having a conical shape with linear outer sides an a planar top and with a base of the conical shape in contact with the membrane, and an actuating member connected to the outer free end of said stem part and being movable in relation to the housing, whereby the switching element may be switched between its first and second states by depressing the actuating member, the movement of the actuating member being transmitted to the switching part through the elastically compressible stem part.

* * * * *

UNITED STATES PATENT AND TRADEMARK OFFICE

CERTIFICATE OF CORRECTION

PATENT NO. : 5,199,557

DATED : 6 April 1993

INVENTOR(S) : Brandt et al.

It is certified that error appears in the above-identified patent and that said Letters Patent is hereby corrected as shown below:

On the title page: Item [54], delete "AND A KEY" and insert --OR A SWITCH--.

In column 1, title, delete "AND A KEY" and insert --OR A SWITCH--.

In column 1, on new line 10, insert the heading --BACKGROUND OF THE INVENTION--.

In column 1, on new line 11, insert the heading --Field of the Invention--.

In column 1, before line 14, insert the heading --SUMMARY OF THE INVENTION--.

In column 1, line 14, delete "eletronic" and insert --electronic--.

In column 2, line 32, delete "tags" and insert --tag--.

In column 4, lines 55 through 61, delete --in said first state is out of electrically conductive contact with at least one of said electric contact means of said at least two metallic terminal components and if said switching element in said second state is establishing electrically conductive contact between said electric contact means of said at least two metallic terminal components--.

UNITED STATES PATENT AND TRADEMARK OFFICE

CERTIFICATE OF CORRECTION

PATENT NO. : 5,199,557

DATED : 6 April 1993

INVENTOR(S) : Brandt et al.

It is certified that error appears in the above-identified patent and that said Letters Patent is hereby corrected as shown below:

In column 6, before line 46, insert the heading --BRIEF DESCRIPTION OF THE DRAWINGS--.

In column 7, before line 3, insert the heading --DESCRIPTION OF THE PREFERRED EMBODIMENTS--.

In column 7, line 6, delete "posititions" and insert --positions--.

In column 7, line 46, delete "a" before the word "second".

In column 7, line 67, delete "14 and 13" and insert --13 and 14--.

In column 8, line 11, insert after the word "and", --is further at its lower side surface, shown in Fig. 2, provided with a--.

In column 9, line 39, delete "opitica" and insert --optical or proximity--.

In column 10, line 38, after the word "resistor", insert --,--.

In column 11, line 64, delete "push-botton" and insert --push-button--.

UNITED STATES PATENT AND TRADEMARK OFFICE

CERTIFICATE OF CORRECTION

PATENT NO. : 5,199,557

DATED : 6 April 1993

INVENTOR(S) : Brandt et al.

It is certified that error appears in the above-identified patent and that said Letters Patent is hereby corrected as shown below:

In column 12, line 15, delete "13" and insert --113--.

In column 12, line 26, delete "diameters" and insert --diametre--.

In column 12, line 62, insert after the word "membrane" --part--.

In column 13, line 42, delete "and" and insert --end--.

In column 14, line 56, delete "a" and insert --an--.

In column 14, line 60, delete "made by" and insert --may be--.

In column 16, line 42, delete "part" and insert --element--.

Signed and Sealed this

Twenty-second Day of March, 1994

*Attest:*

Bruce Lehman

BRUCE LEHMAN

*Attesting Officer*

*Commissioner of Patents and Trademarks*